US010156109B2

(12) United States Patent
Peterson et al.

(10) Patent No.: US 10,156,109 B2
(45) Date of Patent: Dec. 18, 2018

(54) SUBTERRANEAN PUMP WITH PUMP CLEANING MODE

(71) Applicants: Ronald G. Peterson, Racine, WI (US); Jonathan D. Bender, Bakersfield, CA (US)

(72) Inventors: Ronald G. Peterson, Racine, WI (US); Jonathan D. Bender, Bakersfield, CA (US)

(73) Assignee: Unico, Inc., Franksville, WI (US)

( * ) Notice: Subject to any disclaimer, the term of this patent is extended or adjusted under 35 U.S.C. 154(b) by 212 days.

(21) Appl. No.: 15/343,453

(22) Filed: Nov. 4, 2016

(65) Prior Publication Data

US 2017/0074080 A1 Mar. 16, 2017

Related U.S. Application Data

(62) Division of application No. 14/704,079, filed on May 5, 2015, now Pat. No. 9,689,251.
(Continued)

(51) Int. Cl.
*E21B 43/12* (2006.01)
*F04B 49/06* (2006.01)
(Continued)

(52) U.S. Cl.
CPC ..... *E21B 28/00* (2013.01); *E21B 37/00* (2013.01); *E21B 43/126* (2013.01);
(Continued)

(58) Field of Classification Search
CPC ..... E21B 28/00; E21B 37/00; E21B 43/126; E21B 47/0008; E21B 43/003;
(Continued)

(56) References Cited

U.S. PATENT DOCUMENTS 2,551,434 A 5/1951 Gray et al.
2,667,932 A * 2/1954 Bodine, Jr. ..... B01J 19/10 166/177.1
(Continued)

FOREIGN PATENT DOCUMENTS

JP H05012669 2/1993
JP H07103136 4/1995
(Continued)

OTHER PUBLICATIONS

Exlar Roller Screw Basics; website http://www.exlar.com/TI_ref_rollScrew_oview.htnl; date last visited Sep. 22, 2006; 2 pages.
(Continued)

*Primary Examiner* — Dominick L Plakkoottam
(74) *Attorney, Agent, or Firm* — Reinhart Boerner Van Deuren P.C.

(57) ABSTRACT

A method to dislodge debris from a pump system in which the pump system includes a down-hole pump coupled by a rod string to an above-ground pump actuator, which is coupled to a controller configured to operate the pump system. The method also includes determining that the pump system should begin operating in a pump clean mode, and implementing the pump clean mode configured in the controller. The method also includes impressing a preset vibration frequency during a portion of a pump stroke of at least one pump cycle. Further, the method calls for determining that the pump clean mode is complete, and returning the pump system to a normal operation mode.

9 Claims, 10 Drawing Sheets

Related U.S. Application Data

(60) Provisional application No. 61/990,492, filed on May 8, 2014.

(51) Int. Cl.

| | |
|---|---|
| ***E21B 47/00*** | (2012.01) |
| ***E21B 47/02*** | (2006.01) |
| ***E21B 28/00*** | (2006.01) |
| ***F04B 1/12*** | (2006.01) |
| ***F04B 49/12*** | (2006.01) |
| ***F04B 47/00*** | (2006.01) |
| ***E21B 37/00*** | (2006.01) |
| ***F04B 47/02*** | (2006.01) |

(52) U.S. Cl.
CPC ..... *E21B 43/127* (2013.01); *E21B 47/0008* (2013.01); *F04B 1/128* (2013.01); *F04B 47/00* (2013.01); *F04B 47/026* (2013.01); *F04B 49/06* (2013.01); *F04B 49/12* (2013.01); *Y10S 366/60* (2013.01)

(58) Field of Classification Search
CPC ..... E21B 43/26; F04B 1/128; F04B 47/00; F04B 49/12; Y10S 366/60
See application file for complete search history.

(56) References Cited

U.S. PATENT DOCUMENTS 2,691,300 A 10/1954 Morris
2,918,127 A * 12/1959 Bodine, Jr. ..... E21B 43/003 166/177.1
3,203,257 A 8/1965 Geyer
3,343,409 A 9/1967 Gibbs
3,585,484 A 6/1971 Dortort
3,741,686 A 6/1973 Smith
3,765,234 A 10/1973 Sievert
3,851,995 A 12/1974 Mills
3,854,846 A 12/1974 Douglas
3,915,225 A 10/1975 Swink
3,918,843 A 11/1975 Douglas et al.
3,930,752 A 1/1976 Douglas
3,936,231 A 2/1976 Douglas
3,938,910 A 2/1976 Douglas
3,951,209 A 4/1976 Gibbs
3,963,374 A 6/1976 Sullivan
3,965,983 A 6/1976 Watson
3,998,568 A 12/1976 Hynd
4,058,757 A 11/1977 Welton et al.
4,098,340 A * 7/1978 Steele ..... E21B 37/00 166/311
4,102,394 A 7/1978 Botts
4,108,574 A 8/1978 Bartley et al.
4,114,375 A 9/1978 Saruwatari
4,118,148 A 10/1978 Allen
4,145,161 A 3/1979 Skinner
4,171,185 A 10/1979 Duke et al.
4,181,003 A 1/1980 Kononov et al.
4,194,393 A 3/1980 Boley
4,207,763 A 6/1980 Huydts et al.
4,220,440 A 9/1980 Taylor et al.
4,226,404 A 10/1980 Zens
4,276,003 A 6/1981 Perkins et al.
4,286,925 A 9/1981 Standish
4,342,364 A * 8/1982 Bodine ..... E21B 43/003 166/104
4,358,248 A * 11/1982 Bodine ..... E21B 43/003 417/241
4,363,605 A 12/1982 Mills
4,370,098 A 1/1983 McClain et al.
4,390,321 A 6/1983 Langlois et al.
4,406,122 A 9/1983 McDuffie
4,438,628 A 3/1984 Creamer
4,474,002 A 10/1984 Perry
4,476,418 A 10/1984 Werner
4,480,960 A 11/1984 Streib
4,483,188 A 11/1984 McTamaney et al.
4,487,061 A 12/1984 McTamaney et al.
4,487,554 A * 12/1984 Bodine ..... F04F 7/00 366/600
4,490,094 A 12/1984 Gibbs
4,498,845 A * 2/1985 Pittman ..... F04B 47/026 125/13.01
4,507,055 A 3/1985 Fair et al.
4,508,487 A 4/1985 Taylor et al.
4,508,488 A 4/1985 Pikna
4,509,901 A 4/1985 McTamaney et al.
4,534,168 A 8/1985 Brantly
4,534,706 A 8/1985 Palm et al.
4,541,274 A 9/1985 Purcupile
4,551,072 A 11/1985 Barall
4,583,915 A 4/1986 Montgomery et al.
4,590,787 A 5/1986 Trimborn
4,594,665 A 6/1986 Chandra et al.
4,606,217 A 8/1986 Schiller et al.
4,631,918 A 12/1986 Rosman
4,631,954 A 12/1986 Mills
4,644,256 A 2/1987 Farias et al.
4,661,751 A 4/1987 Werner
4,681,167 A 7/1987 Soderberg
4,691,511 A 9/1987 Dollison
4,695,231 A * 9/1987 Bodine ..... E21B 43/003 366/600
4,695,779 A 9/1987 Yates
4,716,555 A * 12/1987 Bodine ..... E21B 43/26 166/249
4,719,811 A 1/1988 Lang et al.
4,741,397 A 5/1988 Weeks
4,747,451 A 5/1988 Adams, Jr. et al.
4,782,258 A 11/1988 Petrosky
4,788,873 A 12/1988 Laney
4,807,518 A 2/1989 Berchtold et al.
4,817,712 A * 4/1989 Bodine ..... E21B 43/003 166/104
4,830,112 A 5/1989 Erickson
4,836,497 A 6/1989 Beeson
4,859,151 A 8/1989 Reed
4,867,000 A 9/1989 Lentz
4,873,635 A 10/1989 Mills
4,935,685 A 6/1990 Justus et al.
4,971,522 A 11/1990 Butlin
4,973,226 A 11/1990 McKee
5,006,044 A 4/1991 Walker, Sr. et al.
5,027,909 A 7/1991 Carter et al.
5,044,888 A 9/1991 Hester, II
5,064,349 A 11/1991 Turner et al.
5,129,264 A 7/1992 Lorenc
5,129,267 A 7/1992 Nicholls
5,167,490 A 12/1992 McKee et al.
5,180,289 A 1/1993 Wenholz et al.
5,204,595 A 4/1993 Opal et al.
5,205,163 A 4/1993 Sananikone
5,222,867 A 6/1993 Walker, Sr. et al.
5,224,834 A 7/1993 Westerman et al.
5,230,607 A 7/1993 Mann
5,237,863 A 8/1993 Dunham
5,240,380 A 8/1993 Mabe
5,246,076 A 9/1993 Watson
5,251,696 A 10/1993 Boone et al.
5,252,031 A 10/1993 Gibbs
5,281,100 A 1/1994 Diederich
5,284,422 A 2/1994 Turner et al.
5,316,085 A 5/1994 Dawson
5,318,409 A 6/1994 London et al.
5,362,206 A 11/1994 Westerman et al.
5,372,482 A 12/1994 London et al.
5,425,623 A 6/1995 London et al.
5,429,193 A 7/1995 Hegebarth et al.
5,435,166 A 7/1995 Sunada
5,441,389 A 8/1995 Wolcott et al.
5,444,609 A 8/1995 Swamy et al.
5,458,466 A 10/1995 Mills
5,522,713 A 6/1996 Lian

(56) References Cited

U.S. PATENT DOCUMENTS

| | | | |
|---|---|---|---|
| 5,557,154 | A | 9/1996 | Erhart |
| 5,577,433 | A | 11/1996 | Henry |
| 5,634,522 | A | 6/1997 | Hershberger |
| 5,656,903 | A | 8/1997 | Shui et al. |
| 5,806,402 | A | 9/1998 | Henry |
| 5,809,837 | A | 9/1998 | Shaffer |
| 5,819,849 | A | 10/1998 | Booth |
| 5,820,350 | A | 10/1998 | Mantely et al. |
| 5,823,262 | A | 10/1998 | Dutton |
| 5,829,530 | A | 11/1998 | Nolen |
| 5,832,727 | A | 11/1998 | Stanley |
| 5,868,029 | A | 2/1999 | Paine |
| 5,941,305 | A | 8/1999 | Thrasher et al. |
| 5,996,691 | A | 12/1999 | Norris et al. |
| 6,015,271 | A | 1/2000 | Boyer et al. |
| 6,041,597 | A | 3/2000 | Huang |
| 6,041,856 | A | 3/2000 | Thrasher et al. |
| 6,043,569 | A | 3/2000 | Ferguson |
| 6,079,491 | A | 6/2000 | Stuebinger et al. |
| 6,092,600 | A | 7/2000 | McKinzie et al. |
| 6,116,139 | A | 9/2000 | Yuda, Jr. et al. |
| 6,127,743 | A | 10/2000 | Levin et al. |
| 6,129,110 | A | 10/2000 | Kolb |
| 6,155,347 | A | 12/2000 | Mills |
| 6,164,935 | A | 12/2000 | Turiansky |
| 6,176,682 | B1 | 1/2001 | Mills |
| 6,275,403 | B1 | 8/2001 | McNulty et al. |
| 6,343,656 | B1 | 2/2002 | Vazquez et al. |
| 6,357,100 | B2 | 3/2002 | Speller, Jr. et al. |
| 6,449,567 | B1 | 9/2002 | Desai et al. |
| 6,464,464 | B2 | 10/2002 | Sabini et al. |
| 6,497,281 | B2 | 12/2002 | Vann |
| 6,585,041 | B2 | 7/2003 | Crossley |
| 6,592,340 | B1 | 7/2003 | Horo et al. |
| 6,615,712 | B2 | 9/2003 | Faitel et al. |
| 6,619,147 | B1 | 9/2003 | Kojima |
| 6,640,601 | B2 | 11/2003 | Hatty |
| 6,756,707 | B2 | 6/2004 | Hochhalter et al. |
| 7,126,294 | B2 | 10/2006 | Minami et al. |
| 7,168,924 | B2 | 1/2007 | Beck et al. |
| 7,321,211 | B2 | 1/2008 | Peterson |
| 7,530,799 | B2 | 5/2009 | Smith |
| 7,588,076 | B2 | 9/2009 | Jin |
| 7,635,022 | B2 | 12/2009 | Han et al. |
| 7,713,035 | B2 | 5/2010 | Ford |
| 8,152,492 | B2 | 4/2012 | Beck et al. |
| 8,360,756 | B2 | 1/2013 | Ford |
| 8,397,083 | B1 | 3/2013 | Sussland et al. |
| 8,708,671 | B2 | 4/2014 | Gregory et al. |
| 2002/0096060 | A1 | 7/2002 | Kohno |
| 2003/0180151 | A1 | 9/2003 | Jeun |
| 2003/0235492 | A1 | 12/2003 | Mirsky et al. |
| 2005/0081660 | A1 | 4/2005 | Migliori |
| 2006/0024171 | A1 | 2/2006 | Smith et al. |
| 2006/0067834 | A1 | 3/2006 | Boyer et al. |
| 2006/0070222 | A1 | 4/2006 | Clew |
| 2006/0090656 | A1 | 5/2006 | Iwashita et al. |
| 2006/0171821 | A1 | 8/2006 | Brown |
| 2007/0098575 | A1 | 5/2007 | Han et al. |
| 2007/0286750 | A1 | 12/2007 | Beck et al. |
| 2009/0097994 | A1 | 4/2009 | Beck et al. |
| 2011/0126012 | A1 | 5/2011 | Ben-Ami et al. |
| 2011/0154041 | A1 | 6/2011 | Godfrey et al. |
| 2011/0232283 | A1 | 9/2011 | Gregory et al. |
| 2011/0252229 | A1 | 10/2011 | Belenkly et al. |
| 2012/0177504 | A1* | 7/2012 | Beck ..... F04B 47/02 417/44.1 |
| 2012/0230841 | A1 | 9/2012 | Gregory et al. |
| 2013/0110943 | A1 | 5/2013 | Menon et al. |
| 2013/0302183 | A1 | 11/2013 | Gregory et al. |
| 2014/0011541 | A1 | 1/2014 | Cormier et al. |
| 2014/0219827 | A1 | 8/2014 | Gregory et al. |
| 2014/0294603 | A1* | 10/2014 | Best ..... E21B 43/129 417/46 |
| 2015/0322755 | A1 | 11/2015 | Peterson et al. |

FOREIGN PATENT DOCUMENTS

| | | | |
|---|---|---|---|
| JP | H11504408 | | 4/1999 |
| JP | 2004028007 | A | 1/2004 |
| JP | 2005054699 | | 3/2005 |
| JP | 2014-051918 | A | 3/2014 |

OTHER PUBLICATIONS

Exlar PRS Series Roller Screw Overview; website http://www.exlar.com/prod_PRS_oview_htnl; date last visited Sep. 22, 2006; 3 pages.

Gibbs, S.C.: "Predicting the Behavior of Sucker-Rod Pumping Systems", JPT (Jul. 1963, 769-78, Trans, AIME 228).

Garlow, M.E.: Sensorless Estimation of a Sucker-Rod Pump Downhold Dynacard, Unico, Inc., Aug. 12, 2002.

Everitt, T.A, and Jennings, J.W.: An Improved Finite-Difference Calculation of Downhold Dynamometer Cards for Sucker-Rod Pumps, Paper SPE 18189, SPE Production Engineering (Feb. 1992).

Jansen, P.L. and Lorenz, R.D.: Accurary Limitations of Velocity and Flux Estimation in Direct Field Oriented Induction Machines, Power Electronics and Applications, 1993, Fifth European Conference on , 1993; 312-318, vol. 4.

Lorenz, R.D. and Lawson, D.B.: A Simplified Approach to Continuous On-Line Tuning of Field-Oriented Induction Machine Drives, IEEE Transactions on Industry Applications, vol. 26, No. 3, May/Jun. 1990.

Hasan, A.R. and Kabir, C.S.: Fluid Flow and Heat Transfer in Wellbores, Society of Petroleum Engineers, Richardson, TX, 2002.

Kuhne, Steven and Riefenstahl, Ulrich: A New Torque Calculator for AC Induction Motor Drives that Improves Accuracy and Dynamic Behavior Apr. 1999, IEEE.

* cited by examiner

SUBTERRANEAN PUMP WITH PUMP CLEANING MODE

CROSS-REFERENCE TO RELATED PATENT APPLICATIONS

This patent application is a divisional of co-pending U.S. patent application Ser. No. 14/704,079, filed May 5, 2015, which claims the benefit of U.S. Provisional Patent Application No. 61/990,492, filed May 8, 2014, the entire teachings and disclosure of which are incorporated herein by reference thereto.

FIELD OF THE INVENTION

The present invention relates generally to sucker rod pump systems as more particularly to cleaning debris from a downhole pump.

BACKGROUND OF THE INVENTION

Sucker rod pumps occasionally encounter solid particles or "trash" during operation. Oftentimes these solids pass harmlessly through the pump. Other times the debris will cause the pump traveling and/or standing valves to not properly seat (stick open, for example). If the traveling or standing valve do not properly seat, the pump will malfunction, adversely affecting the production rate of fluid.

It would therefore be desirable to have a pumping system that addresses some of the aforementioned problems, and further includes embodiments of construction which is both durable and long lasting. It would also be desirable if this pumping system required little or no maintenance to be provided by the user throughout its operating lifetime. Additionally, it would be desirable if the aforementioned pumping system were of inexpensive construction to thereby afford it the broadest possible market. Finally, it is also an objective that all of the aforesaid advantages and objectives be achieved without incurring any substantial relative disadvantage.

The disadvantages and limitations of the background art discussed above are substantially overcome by the present invention.

SUMMARY OF THE INVENTION

There is disclosed a method to dislodge debris from a pump system with the pump system including a downhole pump coupled to a rod string to an above-ground actuator which is coupled to a controller. The controller is configured to operate the pump system, wherein the actuator has an adjustable stroke length.

The method includes determining that the pump system should begin operating in a Pump Clean Mode. Upon start, the Pump Clean Mode is implemented by the controller. The controller cycles the pump actuator at a preset command speed using a preset starting stroke length, preset acceleration rate, and a preset deceleration rate. The controller continues to cycle the pump actuator while incrementally decreasing the stroke length at a preset stroke length increment resulting in increased pump cycling frequencies. The controller determines that the Pump Clean Mode is complete and returns the pump system to a normal operation mode.

The method may also include impressing a preset vibration frequency during a portion of the pump stroke of a pump cycle. In some circumstances the vibration frequency is the pump system rod string resonant frequency.

In another embodiment, the preset command speed of the Pump Clean Mode is a full speed operation for the pump system. In a further embodiment, the controller determines that the pump system should begin operating in the clean mode when it determines that the pump system output has decreased.

The controller can also be configured wherein the step of determining that the Pump Clean Mode is complete comprises determining that the stroke length has become less than or equal to a preset minimum stroke length. The Pump Clean Mode can be implemented in the controller by one of remote telemetry, by a key pad coupled to the controller, or the controller can be configured to automatically operate at a preset time, after a preset stroke count, or automatically upon detection of a malfunction of the pump.

There is also disclosed the method to dislodge debris from a pump system with the pump system including a downhole pump coupled to a rod string and to an above-ground actuator which is coupled to a controller. The controller is configured to operate the pump system.

The method includes determining that the pump system should begin operating in a Pump Clean Mode and implementing the Pump Clean Mode which is configured in the controller. The controller is configured to impress a preset vibration frequency during a portion of the pump stroke for each pump cycle, and when the controller determines that the Pump Clean Mode is complete, the controller returns the pump system to a normal operation mode.

In one embodiment the vibration frequency is the pump system rod string resonant frequency. In a further embodiment, the step of determining that the pump system should begin operating in the Clean Mode includes determining that a preset number of cycles of the pump system have been completed in the normal operation mode. In certain embodiments, the step of determining that the pump system should begin operating in the Clean Mode includes determining that the pump system output has decreased.

A further embodiment provides that the step of determining that the Pump Clean Mode is complete includes determining that a preset number of cycles of the pump system have been completed in the Pump Clean Mode. In particular embodiments, implementation of the Pump Clean Mode is accomplished by one of remote telemetry, key pad, automatically at preset time and automatically upon detection of a malfunction of the pump.

Such an apparatus should be of construction which is both durable and long lasting, and it should also require little or no maintenance to be provided by the user throughout its operating lifetime. In order to enhance the market appeal of such an apparatus, it should also be of inexpensive construction to thereby afford it the broadest possible market. Finally, the advantages of such an apparatus should be achieved without incurring any substantial relative disadvantage.

DESCRIPTION OF THE DRAWINGS

These and other advantages of the present disclosure are best understood with reference to the drawings, in which.

DETAILED DESCRIPTION OF THE DRAWINGS

Sucker rod pumps typically are used in down-hole wells in petroleum production such as oil and gas. During a typical operation, the pump may lose efficiency because of debris sucked into the pump causing loss of production and maintenance costs.

Figure 1:
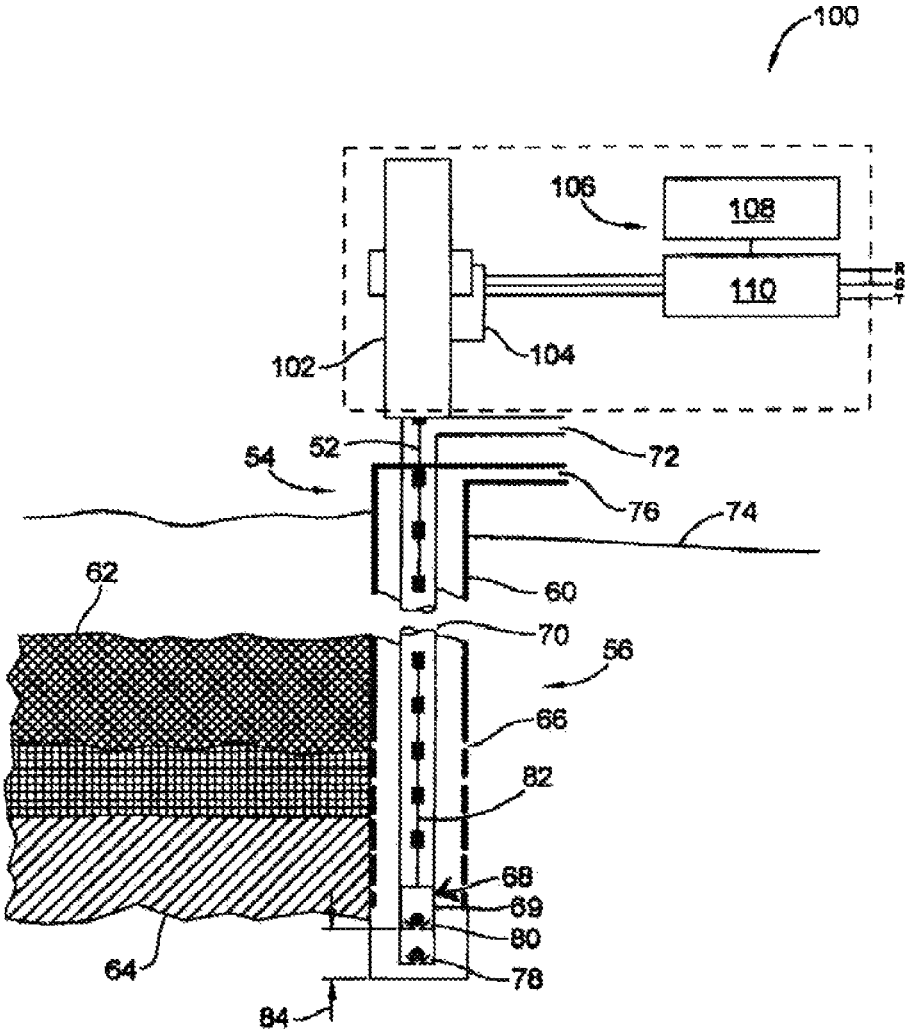
FIG. 1 is an illustration of a linear rod pumping apparatus coupled to a sucker pump type of a downhole pumping apparatus, incorporating an embodiment of the invention.

FIG. 1 is a schematic illustration of a first exemplary embodiment of a linear rod pumping system 100 mounted on the well head 54 of a hydrocarbon well 56. The well includes a casing 60 which extends downward into the ground through a subterranean formation 62 to a depth sufficient to reach an oil reservoir 64. The casing 60 includes a series of perforations 66, through which fluid from the hydrocarbon reservoir enter into the casing 60, to thereby provide a source of fluid for a down-hole pumping apparatus 68, installed at the bottom of a length of tubing 70 which terminates in an fluid outlet 72 at a point above the surface 74 of the ground. The casing 60 terminates in a gas outlet 76 above the surface of the ground 74.

For purposes of this application a sucker rod pump is defined as a down-hole pumping apparatus 69 that includes a stationary valve 78, and a traveling valve 80. The traveling valve 80 is attached to a rod string 82 extending upward through the tubing 70 and exiting the well head 54 at the polished rod 52. Those having skill in the art will recognize that the down-hole pumping apparatus 68, in the exemplary embodiment of the invention, forms a traditional sucker-rod pump 69 arrangement for lifting fluid from the bottom of the well 56 as the polished rod 52 imparts reciprocal motion to rod string 82 and the rod string 82 in turn causes reciprocal motion of the traveling valve 80 through a pump stroke 84. In a typical hydrocarbon well, the rod string 82 may be several thousand feet long and the pump stroke 84 may be several feet long.

As shown in FIG. 1, the first exemplary embodiment of a linear rod pump system 100, includes an above-ground actuator 92, for example a linear mechanical actuator arrangement 102, a reversible motor 104, and a control arrangement 106, with the control arrangement 106 including a controller 108 and a motor drive 110. The linear mechanical actuator arrangement 102 includes a substantially vertically movable member attached to the polished rod 52 for imparting and controlling vertical motion of the rod string 82 and the sucker-rod pump 69.

The reversible motor, for example an electric motor or a hydraulic motor of a linear rod pump apparatus, includes a reversibly rotatable element thereof, operatively connected to the substantially vertically movable member of the linear mechanical actuator arrangement 102 in a manner establishing a fixed relationship between the rotational position of the motor 104 and the vertical position of a rack. As will be understood, by those having skill in the art, having a fixed relationship between the rotational position of the motor 104 and the vertical position of the polished rod 52 provides a number of significant advantages in the construction and operation of a sucker-rod pump apparatus, according to the invention.

Figure 2:
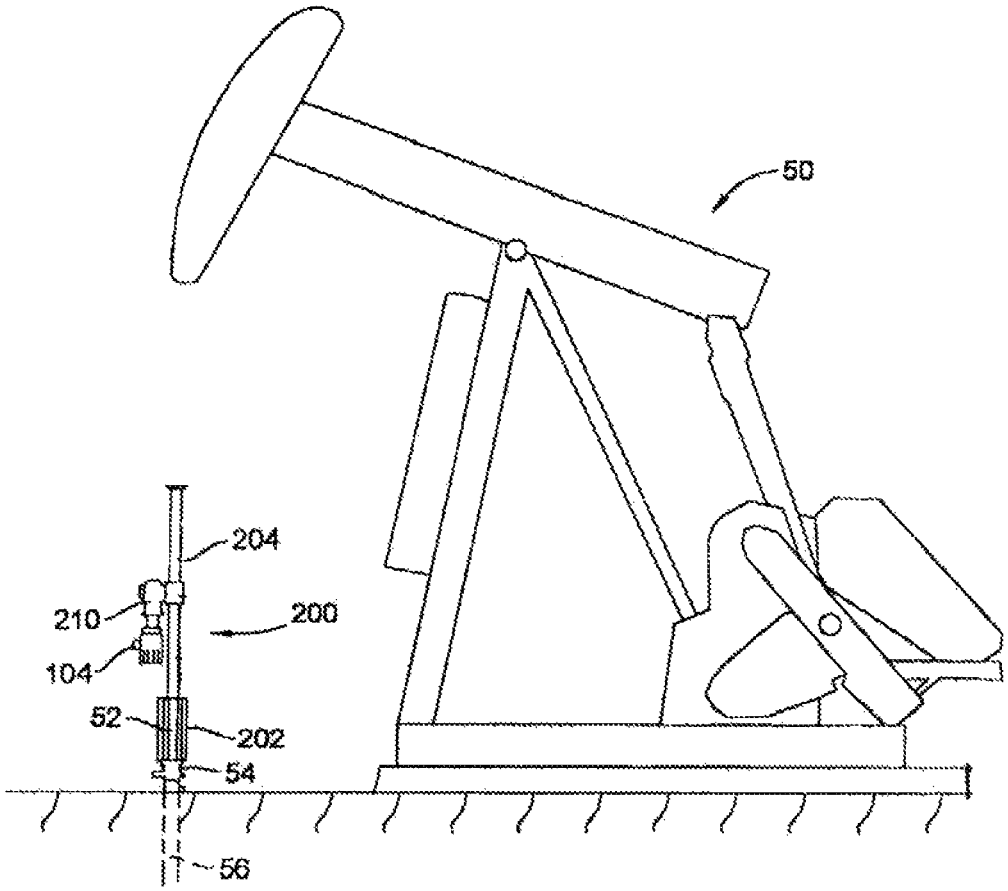
FIG. 2 is a schematic illustration of the linear rod pumping apparatus coupled to a wellhead decoupled from a walking beam pumping apparatus, incorporating an embodiment of the invention.

FIG. 2 shows an exemplary embodiment of a linear rod pumping apparatus 200, mounted on a standoff 202 to the well head 54, and operatively connected for driving the polished rod 52. In FIG. 2, the exemplary embodiment of the linear rod pumping apparatus 200 is illustrated adjacent to the walking beam pumping apparatus 50, to show the substantial reduction in size, weight, and complexity afforded through practice of the invention, as compared to prior approaches utilizing walking beam apparatuses 50.

As shown in FIG. 2, the exemplary embodiment of the linear rod pumping apparatus 200 includes a linear mechanical actuator arrangement 204 which, in turn, includes a rack and pinion gearing arrangement having a rack and a pinion operatively connected through a gearbox 210 to be driven by a reversible electric motor 104.

Occasionally debris will dislodge or clear as a result of normal operation of the pump, with no intervention required. Other times it is necessary for a crew to use specialized equipment to "flush" the pump, or possibly even pull the pump out of the wellbore for inspection and remediation. Some operators may attempt to "bump down," where the pump and rod string are dropped from a short distance in an attempt to dislodge the debris through the shock of the pump plunger striking the bottom. These types of interventions are expensive and time consuming. Furthermore, lost production when the pump is malfunctioning can be a major loss of revenue for the producer.

The methods described herein are for an autonomous process for clearing debris from a typical sucker rod pump system with little or no user intervention required, ultimately resulting in increased profit for the petroleum producer through increased production and reduced maintenance costs. Embodiments of the invention include a process, as disclosed herein, in which may be embedded into the sucker rod pumping unit prime mover (a controlled drive system).

Figure 3:
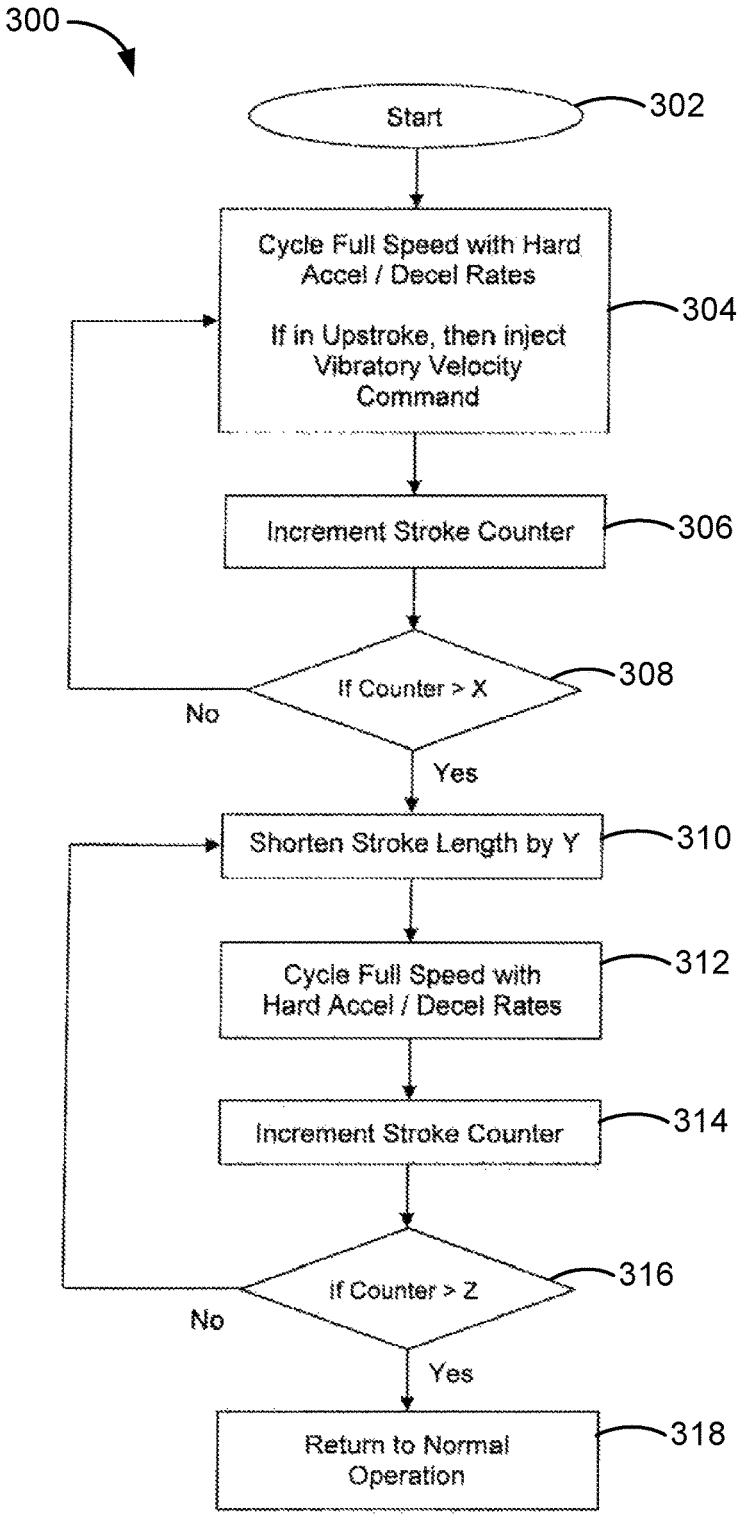
FIG. 3 is a flow chart of an exemplary embodiment of a Pump Clean Mode configured in a controller of the linear rod pumping apparatus as illustrated in FIG. 1, in accordance with an embodiment of the invention.

In one embodiment, the process is implemented in a Unico LRP® sucker rod pumping unit system. A Pump Clean Mode 300, as illustrated in the flowchart of FIG. 3, is embedded in the controller 108, and can be used to automatically clear debris from the pump. The Pump Clean Mode 300 routine can be executed by a control arrangement 106 which includes at least one of a remotely (through, for example RFI or WiFi telemetry), at a pump system keypad, automatically at preset times, or automatically if the controller 108 detects a malfunctioning pump valve 78, 80.

In general, the Pump Clean Mode 300 vibrates the pump at strategic predetermined frequencies for a predetermined time, for example approximately two minutes to dislodge debris on the pump valve 78, 80, allowing the debris to pass through the valves 78, 80 and into the pipe string 82 of the wellbore 60. More specifically, in certain embodiments, there are two separate phases to the Pump Clean Mode 300: 1) High speed normal operation with vibration during the upstroke of the pump; and 2) High speed oscillation of the pumping unit by progressively shortening the pumping stroke.

Referring again to FIGS. 1 and 2, the act of vibrating the pumping unit causes kinetic energy to be transmitted to the downhole pump 68 via the rod-string 82 in the form of shock loads in excess of the normal pump operational loads. The acceleration peaks of the shock loads serve to jar debris loose. The vibration is most useful during the upstroke of the pump, when the traveling valve 80 attempts to seat.

To maximize the energy of the shock load (peaks) transferred to the down-hole pump 68, it is desirable to oscillate the rod string 82 at its natural resonant frequency. This can be accomplished incidentally by sweeping through a frequency spectrum, or by targeting the rod-string resonant frequency, calculated with the following equation:

$$a.\ f = \frac{1}{2\pi}\sqrt{\frac{\kappa}{M}}$$

In this equation, f is the natural frequency and M is the mass of the rod 52, which is found by dividing the weight (W) by gravity M=W/g. K is the stiffness of the rod and depends upon the length of the rod, its Modulus of Elasticity (material property), and the moment of inertia.

One method for sweeping frequencies is to progressively shorten the pump stroke 84 while operating the pumping unit at full speed, causing a corresponding increase in stroking frequency (strokes per minute). At some point during this sweep, the stroking frequency will match the rod-string natural frequency. An added benefit to this technique is establishment of a state whereby both the traveling and standing valves 78, 80 of the sucker rod pump 69 are opened simultaneously, allowing loosened debris to backflow through the pump and be deposited at the bottom of the wellbore.

To summarize, the Pump Clean Mode 300 vibrates the pumping unit during the upstroke and oscillates the rod-string 82 at various frequencies by progressively shortening the pumping stroke. The flowchart of FIG. 3 illustrates an embodiment of the Pump Clean Mode 300 process. The Pump Clean Mode 300 is included in the controller 108. In a particular embodiment, the controller 108, shown in FIG. 1, will use estimated down-hole states including pump load and position to determine the best operating mode. These down-hole states can also be used to detect a stuck valve condition, as demonstrates in the following examples below. If the controller 108 detects a stuck valve condition, the Pump Clean Mode 300 can be initiated in the controller 108 by one of the four ways described above.

In FIG. 3, the Pump Clean Mode 300 is initialized at start 302, then in sequence:

- 304 Cycle pumping unit up and down in a normal manner, at preset high speed, with preset hard acceleration and deceleration rates, with a preset vibration frequency introduced during the upstroke;
- 306 Increment stroke counter after the pumping unit has completed a full stroke;
- 308 If stroke counter is greater than preset amount X, then move to block 310, else continue to execute 304;
- 310 Shorten stroke length by preset amount Y, causing the pumping unit to stroke (up and down) a shorter distance than previously;
- 312 Cycle pumping unit up and down in a normal manner, at preset high speed, with preset hard acceleration and deceleration rates. The unit is now cycling with a shorter stroke length, and hence the stroking frequency (strokes per minute) is increased;
- 314 Increment stroke counter after the pumping unit has completed a full stroke;
- 316 If stroke counter is greater than preset amount Z, then move to block 318 (Pump Clean cycle is complete—return to normal operation), else continue to execute 310 (progressively shorten stroke length);

Laboratory Simulation of Pump Clean Mode

Figure 4A:
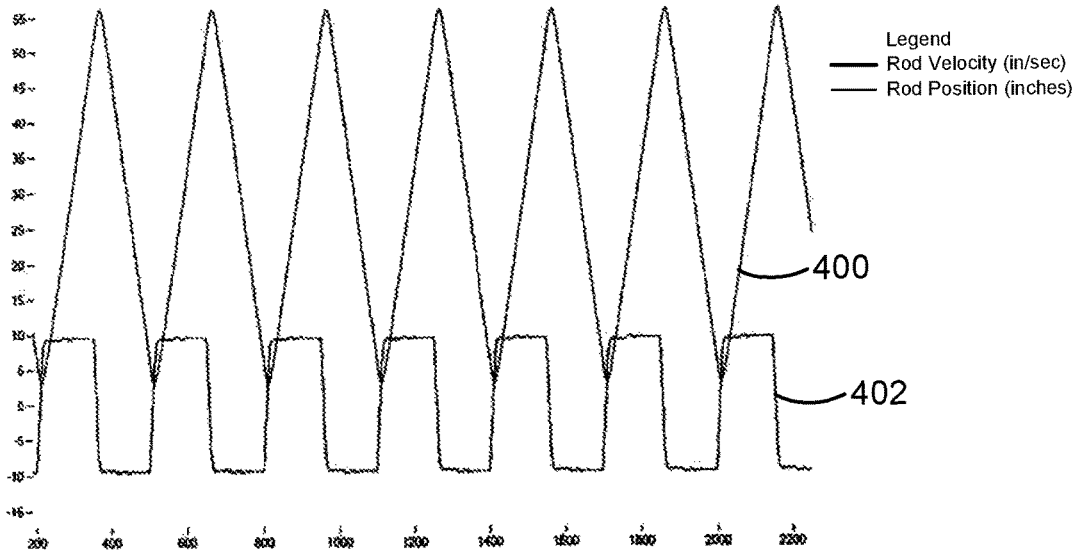
FIGS. 4A and 4B are graphical illustrations showing normal operation of a sucker rod pump type of linear rod pumping apparatus as configured for five strokes per minute (SPM).
Figure 4B:
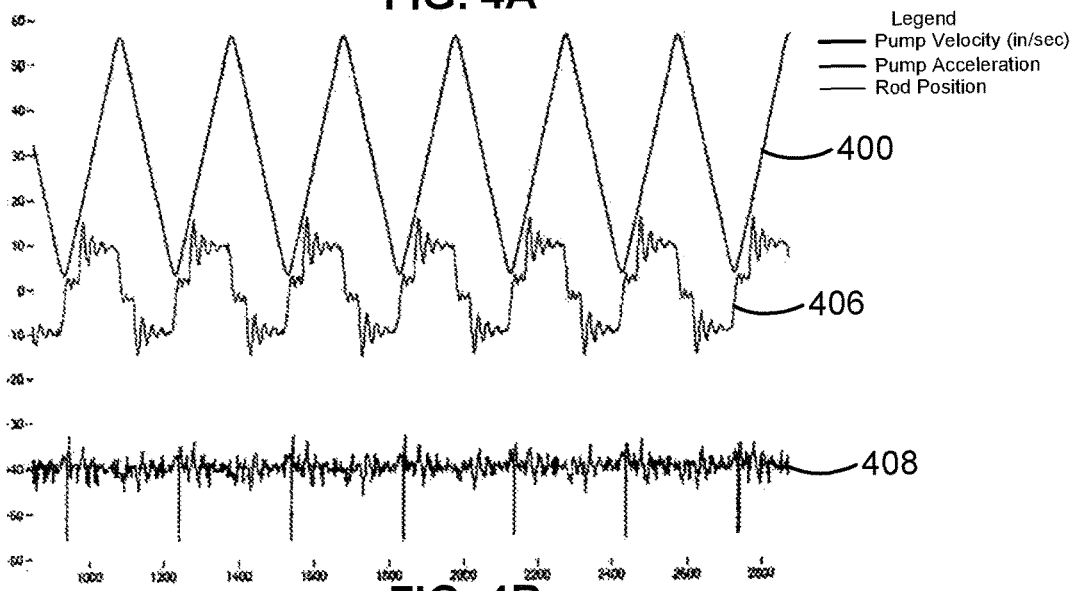

FIGS. 4A and 4B are graphical illustrations showing normal operation of a 56-inch sucker rod pump, for example a linear rod pump, on an example well (4,000 feet deep, 1.5 inch pump, ¾ inch steel rods). Rod position 400 is shown in inches, rod velocity 402 is shown in in/sec in FIG. 4A, while in FIG. 4B downhole pump velocity 406 is shown in in/sec, and downhole pump acceleration 408 is shown in in/sec$^2$. Pump acceleration 408 is shifted down by 40 units on the vertical axis for clarity.

Figure 5A:
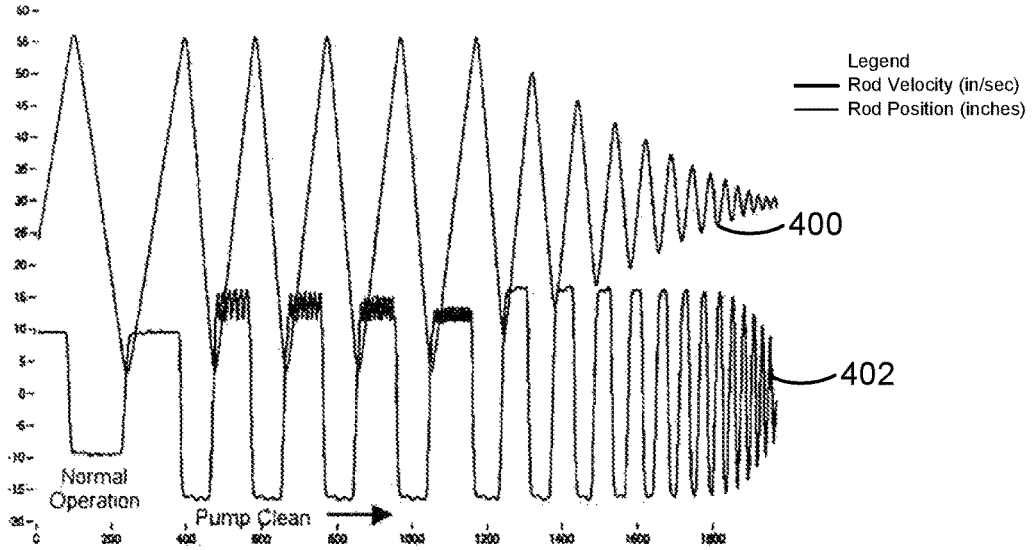
FIGS. 5A and 5B are graphical illustrations showing exemplary system performance during a transition from normal operation of the linear rod pumping apparatus to a Pump Clean Mode, in accordance with an embodiment of the invention.
Figure 5B:
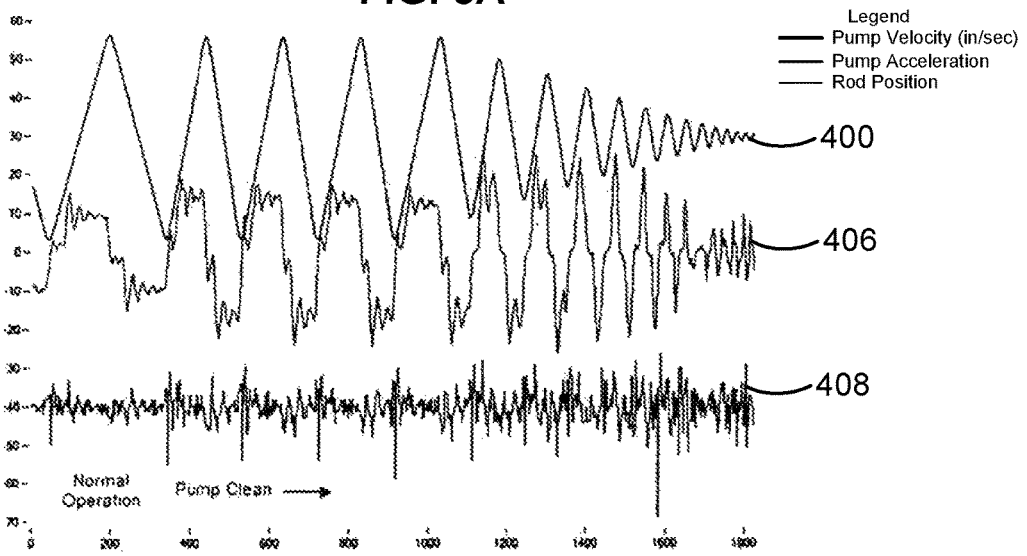

FIGS. 5A and 5B are graphical illustrations showing exemplary system performance during a transition from normal operation to the Pump Clean Mode 300. FIG. 5A shows an increase in rod velocity 502 after the transition to Pump Clean Mode 300., and FIG. 5B shows that pump velocity 406 and acceleration 408 are increased when resonant frequencies are excited (as compared to FIG. 4B). The pump motor 104 vibrates during the pump upstroke, and the stroke length gets progressively shorter, causing the stroking rate (strokes per minute) to increase. At the rod string resonant frequency, the pump dynamic force (acceleration) is maximized, thus imparting a disruptive force on the debris. At high oscillation frequency, both valves, standing 78 and traveling 80, will remain open, allowing the debris to pass through the pump and into the well "rathole."

Field Results of Pump Clean Mode

The linear rod pump system 100 including the controller 108 configured with Pump Clean Mode 300 was deployed with a remote monitoring system on an oil well. The pump periodically produces solids that cause the traveling valve 80 to stick open. A remote monitoring system of the pump system 100 provides operational and diagnostic reports including an alarm if the pump system 100 malfunctions, such as a pump valve 80 becoming stuck, at which time the Pump Clean Mode 300 feature may be initiated.

The traveling valve 80 was observed to stick occasionally during normal operation of the sucker rod pump 69. In some cases the problem would clear by itself. Other times it would persist indefinitely. The Pump Clean Mode 300 successfully restored normal operation to the pump 68 subsequent to a stuck traveling valve 80 event. The charts of FIGS. 6 to 10 illustrate one such example.

Figure 6:
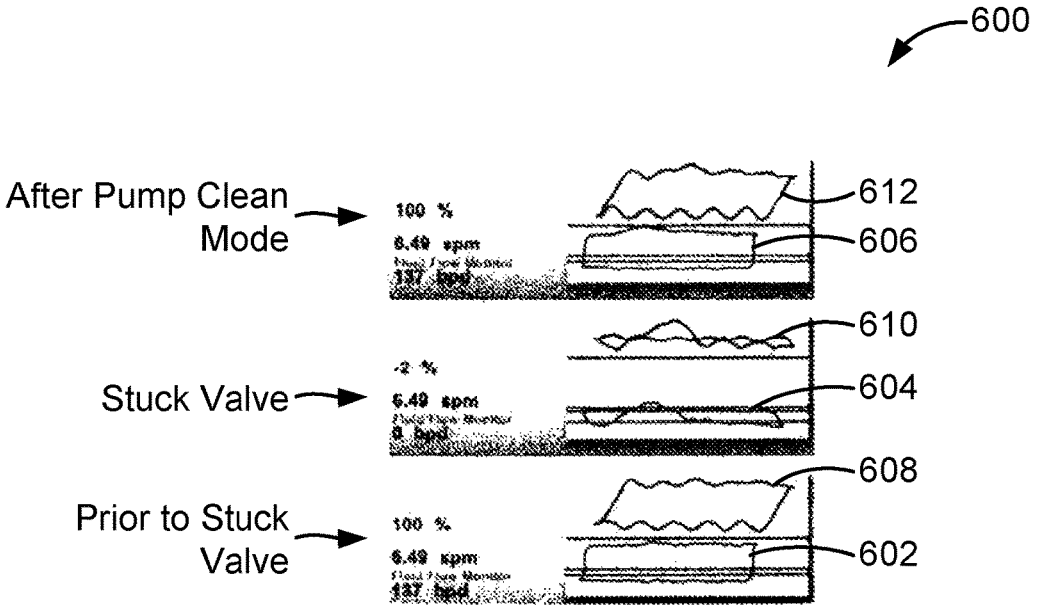
FIG. 6 is a series of exemplary graphical illustrations showing dynamometer trend traces illustrating a stuck valve of the pump and dynamometer traces before and after a Pump Clean Mode operation, according to an embodiment of the invention.

FIG. 6 shows an exemplary display 600 that includes a dynamometer trend leading up to the stuck valve 80 and subsequent to the Pump Clean Mode 300 implementation in the controller 108. In particular embodiments, the display 600 would be available to remote users operating the pump system 100 via remote telemetry. The dynamometer trend is illustrated in a series of graphs include a first graph 602 showing pump system operation prior to the stuck valve 80. First graph 602 shows a production rate of 137 barrels per day (BPD) and a pump fill rate of 100%. A first load graph 608 illustrating the rod load vs. rod position during normal operation is also shown. The data is collected by the controller 108 and reported using a remote well monitoring tool (not shown).

Figure 10:
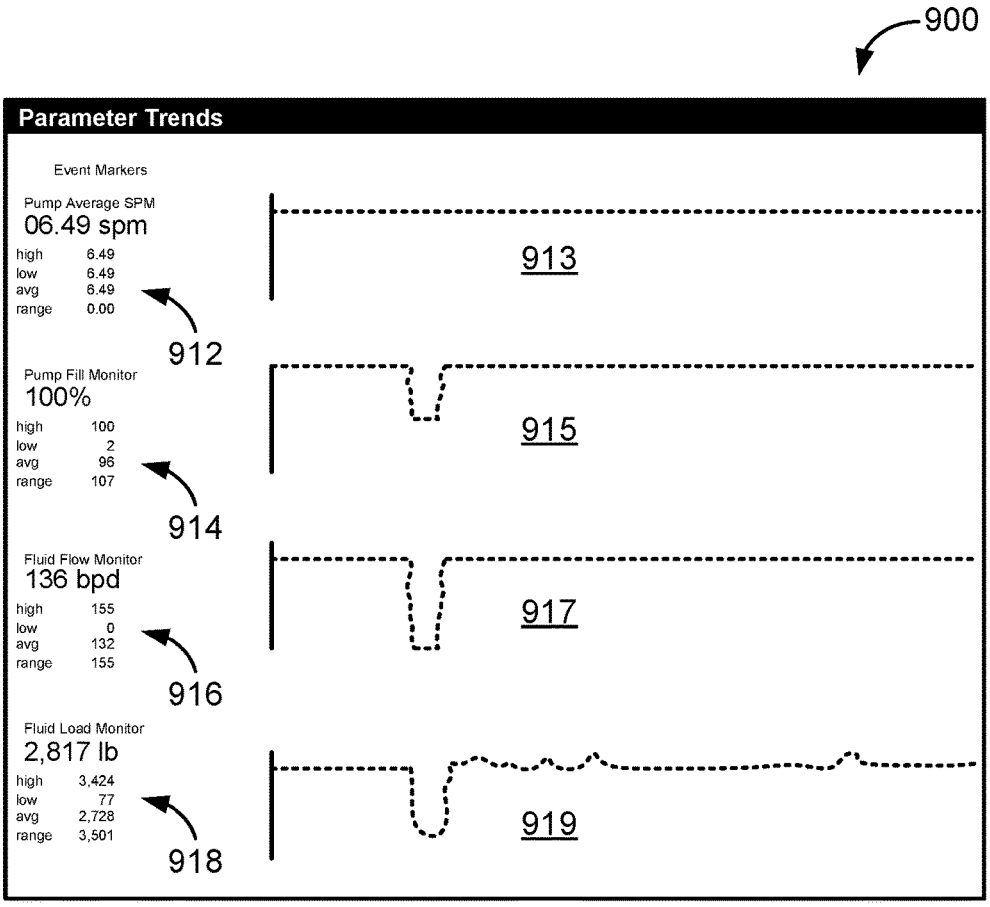
FIG. 10 illustrates an exemplary pump load trend during a stuck valve event and after initiation of a Pump Clean Mode process, according to an embodiment of the invention.

A second graph 604 shows pump system operation after the valve 80 becomes stuck. In this graph 604, the production rate has fallen to zero and the pump fill rate is −2. A second load graph 610 shows the change in rod load vs. rod position, when the valve 80 is stuck as compared to that shown during normal operation. In certain embodiments, the operator is alerted to the problem from the remote monitoring system summary trend 910, as shown in FIG. 10. The summary trend 910 also shows that the production rate is an estimated zero barrels per day (BPD), while the pump fill was −2, and the pump load was zero (no fluid being lifted). It can also be seen from FIGS. 6 and 10 that the problem was observed to be persistent. A third graph 606 shows pump system operation after the implementation of the Pump Clean Mode 300 in which all parameters and a third load graph 612 are returned to normal.

Figure 7:
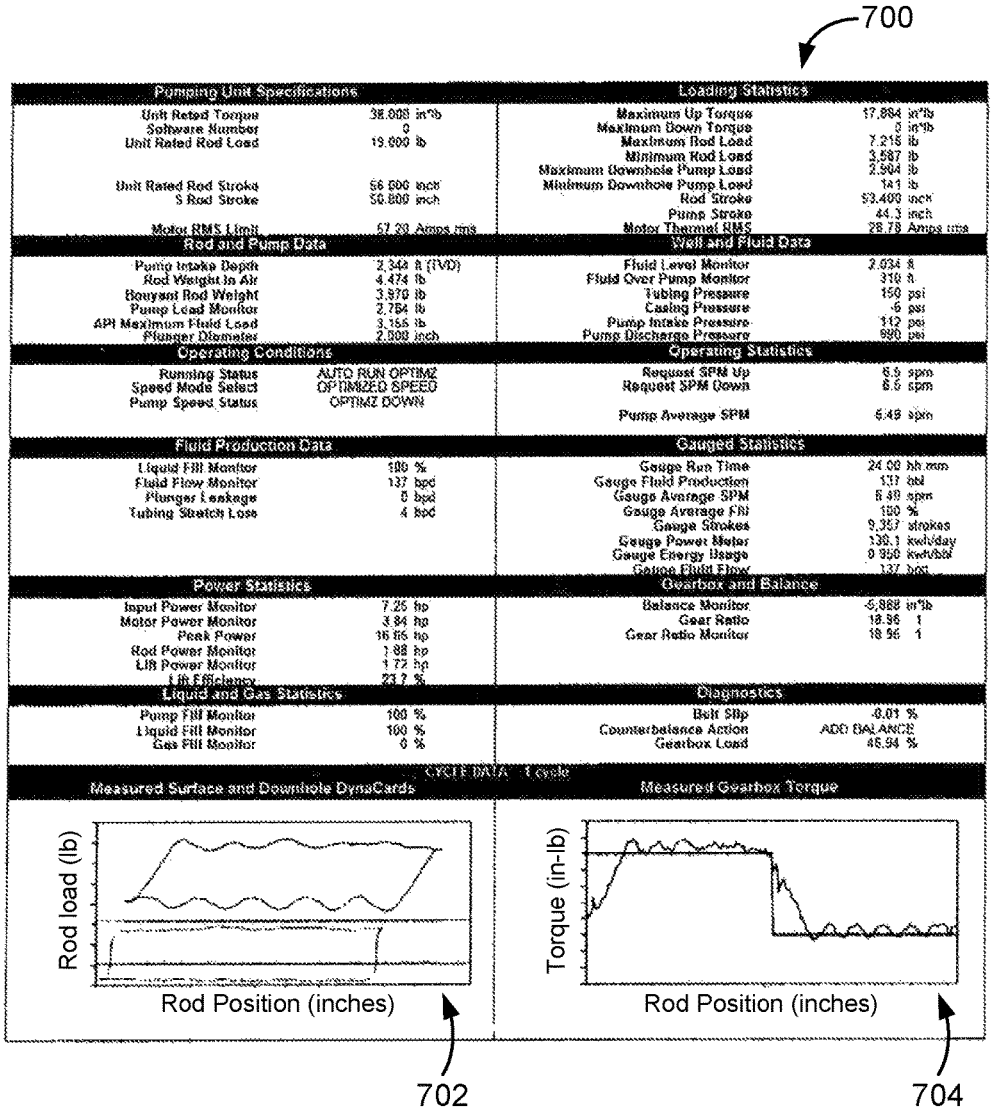
FIGS. 7-9 illustrate exemplary Well Reports generated by the controller illustrated in FIG. 1 at time periods, respectively, prior to a stuck valve event, during a valve stuck open, and after a Pump Clean Mode operation, according to an embodiment of the invention.

FIG. 7 shows an exemplary first Well Report 700 generated by the controller 108 prior to the stuck valve 80 (i.e., normal operation). The dynamometer plots 702, 704 show pump operation is operating properly. The inferred production rate is 137 BPD and the pump fill monitor shows that the pump fill rate is 100%. In the embodiment of FIG. 7, the first Well Report 700 includes data for the following parameters: Pumping Unit Specification; Road and Pump Data; Operating Conditions: Fluid Production Data; Power Statistics; Liquid and Gas Statistics; Loading Statistics; Well and Fluid Data; Operating Statistics; Gauged Statistics; Gearbox and Balance; and Diagnostics. In, alternative embodiments, the Well Report 700 could include a fewer or greater number of operating parameters.

Figure 8:
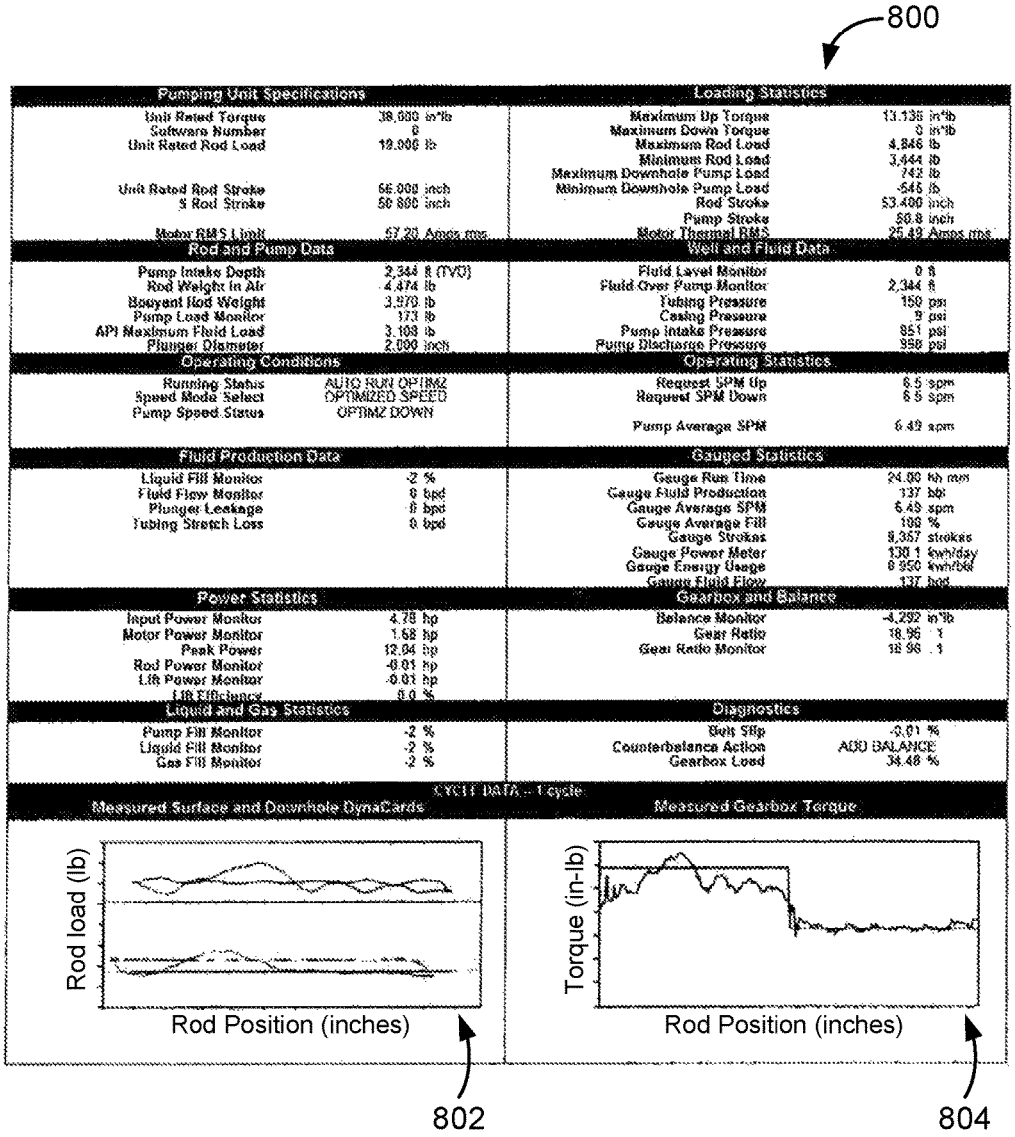

FIG. 8 shows an exemplary second Well Report 800 generated by the controller 108 when the pump traveling valve 80 is stuck open. The dynamometer plots 802, 804 reveal that the pumping unit is raising and lowering only the weight of the rod string (no fluid load). This condition is indicated in the Fluid Production Data section by a 0 BPD production rate, and in the Liquid and Gas Statistics section by a −2 pump fill rate. The problem could either be a parted rod (near the pump) or a stuck valve 80. In this example, it is a stuck valve 80.

Figure 9:
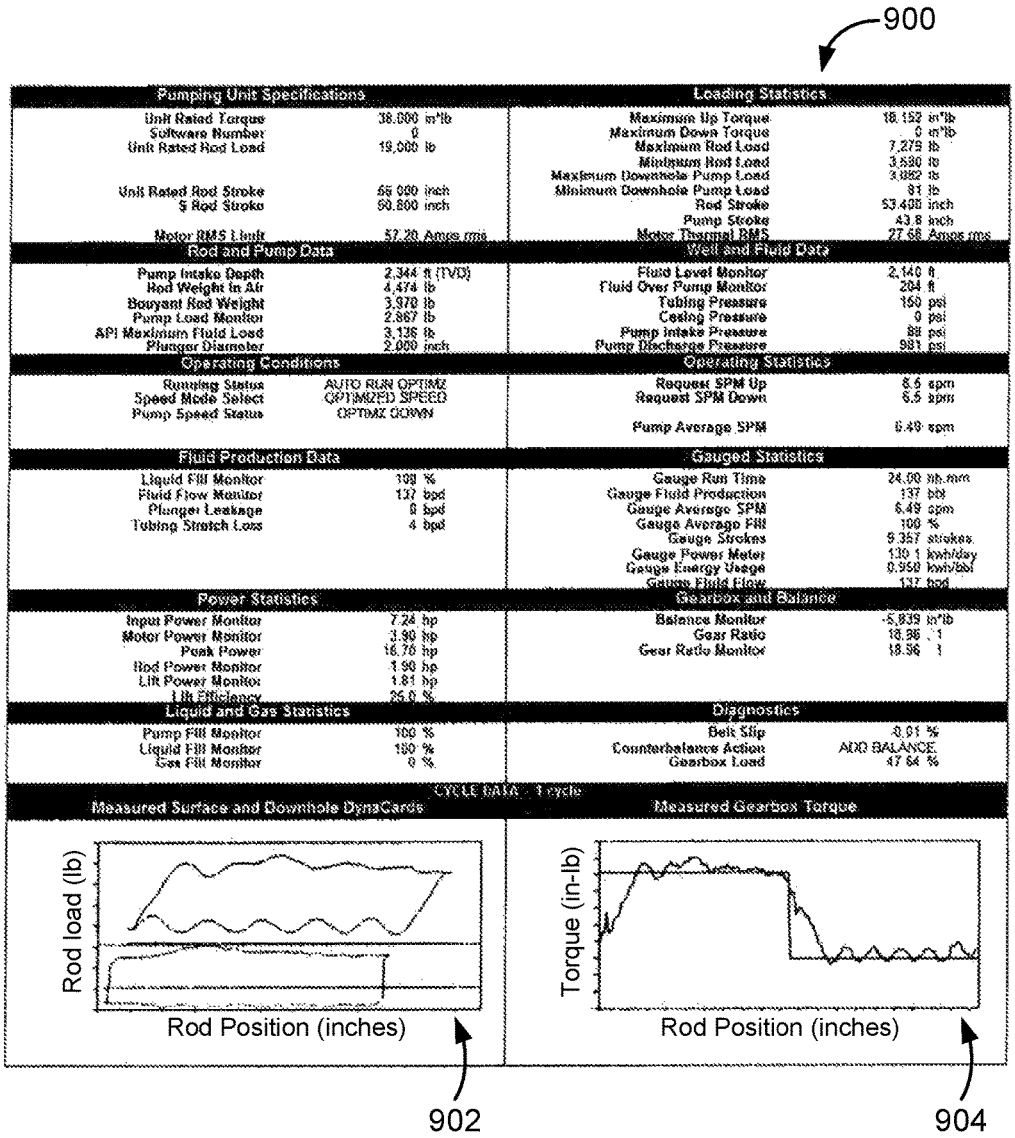

In particular embodiments, the operator initiates remotely the Pump Clean Mode 300, after which the pump valve operation was immediately restored. FIG. 9 shows an exemplary third Well Report 900 after the Pump Clean Mode 300 feature was executed. The dynamometer plots 902, 904 show that pump operation has returned to normal following implementation of the Pump Clean Mode 300. In particular embodiments of the invention, the controller 108 is configured to automatically execute a Pump Clean Mode 300 when a stuck valve condition is detected.

In another example, some sticking of the pump plunger (not shown) is observable during the upstroke in FIG. 6 (the pump load bulges out). This is likely an indicator of the same solids that clogged the traveling valve 80, but in this case also interfering with the plunger. The effect is also observed in an exemplary increased pump load trend 910, generated by the controller 108 subsequent the stuck valve 80, as illustrated in FIG. 10. In the embodiment of FIG. 10, there are four event markers: Pump Average SPM 912 with accompany graph 913; Pump Fill Monitor 914 with accompany graph 915; Fluid Flow Monitor 916 with accompany graph 917; and Pump Load Monitor 918 with accompany graph 919.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A method to dislodge debris from a pump system, the pump system including a down-hole pump coupled by a rod string to an above-ground actuator which is coupled to a controller configured to operate the pump system, the method comprising:

determining that the pump system should begin operating in a pump clean mode;

implementing the pump clean mode configured in the controller;

impressing a preset vibration frequency during a portion of a pump stroke of at least one pump cycle;

determining that the pump clean mode is complete; and returning the pump system to a normal operation mode.

2. The method of claim 1, wherein the preset vibration frequency is the pump system rod string resonant frequency.

3. The method of claim 1, wherein the step of determining that the pump system should begin operating in the pump clean mode comprises determining that a preset number of cycles of the pump system have been completed in the normal operation mode.

4. The method of claim 1, wherein the step of determining that the pump system should begin operating in the pump clean mode comprises determining that a pump system output has decreased.

5. The method of claim 1, wherein the step of determining that the pump clean mode is complete comprises determining that a preset number of cycles of the pump system have been completed in the pump clean mode.

6. The method of claim 1, wherein the implementation of the pump clean mode is accomplished by a control arrangement configured with one of remote telemetry, key pad, automatically at preset time, and automatically upon detection of a malfunction of the pump.

7. The method of claim 1, wherein the pump actuator has an adjustable stroke length, the method further comprising:

cycling the pump actuator at a preset command speed using a preset starting stroke length, preset acceleration rate and a preset deceleration rate; and continuing to cycle the pump actuator while incrementally decreasing the stroke length by a preset stroke length increment resulting in increased pump cycling frequencies.

8. The method of claim 7, wherein the preset command speed is a full speed for the pump system.

9. The method of claim 7, wherein the step of determining that the pump clean mode is complete comprises determining that the stroke length has become less than or equal to a preset minimum stroke length.

* * * * *